US008373055B2

(12) United States Patent
Kira

(10) Patent No.: US 8,373,055 B2
(45) Date of Patent: Feb. 12, 2013

(54) APPARATUS, METHOD AND COMPUTER PROGRAM FOR SWITCHING MUSICAL TONE OUTPUT

(75) Inventor: Yoshifumi Kira, Hamamatsu (JP)

(73) Assignee: Kawai Musical Instruments Mfg. Co., Ltd., Hamamatsu-Shi (JP)

( * ) Notice: Subject to any disclaimer, the term of this patent is extended or adjusted under 35 U.S.C. 154(b) by 468 days.

(21) Appl. No.: 11/989,932

(22) PCT Filed: Mar. 31, 2006

(86) PCT No.: PCT/JP2006/306940

§ 371 (c)(1),
(2), (4) Date: Feb. 4, 2008

(87) PCT Pub. No.: WO2007/015321

PCT Pub. Date: Feb. 8, 2007

(65) Prior Publication Data

US 2010/0083814 A1 Apr. 8, 2010

(30) Foreign Application Priority Data

Aug. 2, 2005 (JP) ..... 2005-224058

(51) Int. Cl.
*G10H 1/06* (2006.01)

(52) U.S. Cl. ..... 84/622; 84/625; 84/634

(58) Field of Classification Search ..... 84/622
See application file for complete search history.

(56) References Cited

U.S. PATENT DOCUMENTS 3,829,597 A * 8/1974 Peterson et al. ..... 84/635
5,085,119 A * 2/1992 Cole ..... 84/724
5,981,860 A * 11/1999 Isozaki et al. ..... 84/603

FOREIGN PATENT DOCUMENTS

JP A 5-249969 9/1993
JP A 6-83338 3/1994
JP A 11-109966 4/1999

* cited by examiner

*Primary Examiner* — Christopher Uhlir
(74) *Attorney, Agent, or Firm* — Oliff & Berridge, PLC

(57) ABSTRACT

In the multi-timbre states in which musical tones with various timbres are outputted or imputed simultaneously and in the non-multi-timber states in which musical tones with a single timbre are outputted or inputted, the most suitable state of transmitting musical tone data is provided. When the non-multi-timber states is selected (step 12), the zones "1" and "2" turn into the in-communication states (INT) and the zones "3" and "4" turn into the out-communication states (EXT). When the multi-timbre states is selected (step 12), all the zones/timbres turn into the both-communication states (BOTH) (step 13). The both-communication states provide said in and out-communication states simultaneously. In the out-communication states, tone data are sent to the external apparatus connected to the musical tone (internal) apparatus. In the in-communication states musical tone data are sent only within the musical tone (internal) apparatus.

11 Claims, 9 Drawing Sheets

FIG. 3

43(4)

| the multi-timbre mode | | |
|---|---|---|
| on／off (1／0) | | |
| | mode of each zone | output state flag |
| 1 | INT/EXT/BOTH | flag |
| 2 | INT/EXT/BOTH | flag |
| 3 | INT/EXT/BOTH | flag |
| 4 | INT/EXT/BOTH | flag |

APPARATUS, METHOD AND COMPUTER PROGRAM FOR SWITCHING MUSICAL TONE OUTPUT

BACKGROUND OF THE INVENTION

1. Field of the Invention

The present invention relates to an apparatus, method and computer program for switching musical tone output.

2. Description of Related Art

There have been electronic musical instruments and musical tone apparatus having a function called "multi-timbre". At the multi-timbre states, musical tones with various timbres are generated at the same time. While the multi-timbre states are removed into the non-multi-timber states, musical tones with a single timbre are generated.

Electronic musical instruments generate sounds with various timbres from the internal sound source equipped in the apparatus (in-communication states). Otherwise by a system called MIDI, musical tone data is sent outward, so that an external sound source generates sounds or records the musical tone data (out-communication states), or tone data is received from outward and an internal sound source generates sounds or records the musical tone data. In this way musical tone data is sent and received between an internal and external apparatuses.

However, switching of the multi-timbre function, the in-communication states and the out-communication states made by the MIDI system, and switching between the in and out-communication states are not mutually related but are separately carried out. The purpose of the present invention is to switch the in, out and both-communication states of musical tone data properly according to switching of the multi-timbre function.

3. Related Works (1) Patent application Publication No. 5-249969

SUMMARY OF THE INVENTION

1. Present Invention

So as to achieve the above-mentioned purpose, in the present invention while the non-multi-timbre states is selected, either in or out-communication states is selected. And while the multi-timbre states are selected, the both-communication state is selected for sending the tone data. At that time the present invention enables switching between the multi-timbre states in which musical tones with various timbres are inputted or outputted simultaneously, and the non-multi-timbre states in which the multi-timbre states is removed and musical tones with a single timbre are inputted or outputted. Switching is made possible among the out-communication states in which musical tone data is sent to the external apparatus connected to the musical tone apparatus, the in-communication states in which tone data is sent only inside said musical tone apparatus, and the both-communication state in which the in and out-communication states are provided simultaneously.

2. Effects of the Invention

While the multi-timbre states are selected for instance, the both-communication state is selected for exchanging tone data. If musical factors such as timbres are changed in the multi-timber state, the changed data is sent to both the internal and external apparatuses. Therefore the change is mutually shared by the internal apparatus (inward) and external apparatus (outward), and no confusion is caused. As a result it is made easy that tone data is written in/recorded and read out/replayed by the connected external apparatus in a multi-timbre states without complicated set-up and switching of modes.

While the non-multi-timbre is selected, which means that either of the out or in-communication states is selected, musical factors such as timbres are changed respectively in the external apparatus and the internal apparatus at the non-multi-timbre states. Thus at the non-multi-timbre states this mechanism is convenient when the external apparatus connected to the musical tone apparatus is used only for a sound source and when the musical tone apparatus (the internal apparatus) is used only as an external or internal sound source, for a complicated set-up/switching of mode is not necessary.

Such is the same when data is exchanged by a single channel and MIDI sound source is used as an extended timbre of the internal sound source.

BRIEF DESCRIPTION OF THE DRAWINGS

FIG. 3 illustrates a made register 43 in the program/data storage unit 4.

DESCRIPTION OF THE PREFERRED EMBODIMENT (1) Overall Circuitry

Figure 1:
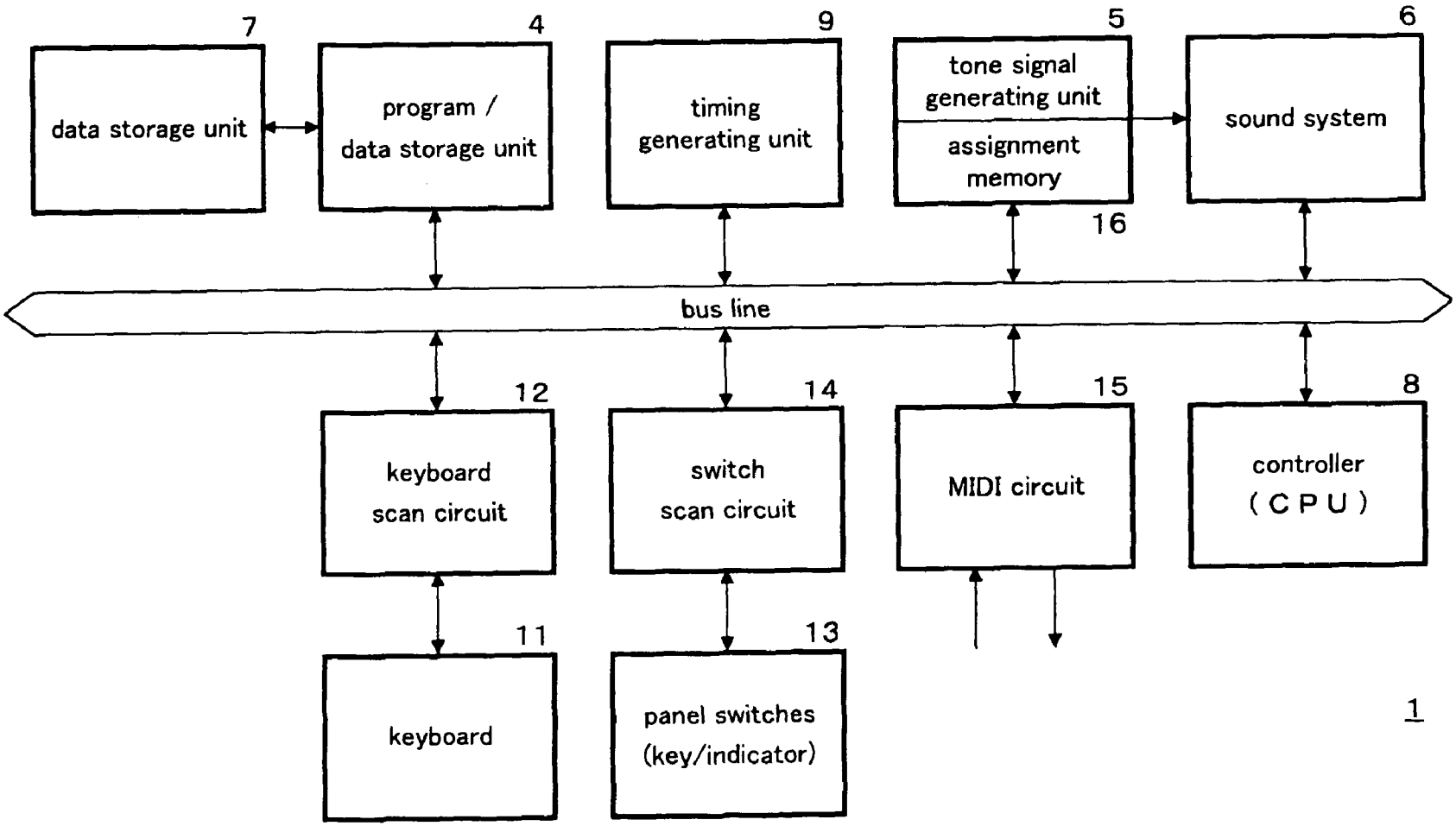
FIG. 1 is a diagram illustrating the whole circuitry of an apparatus for switching a tone output.

FIG. 1 is a diagram illustrating the overall circuitry of a tone output switching apparatus 1 (a method, device to practice a program, automatic/manual play device, a sequencer, a sound source apparatus, a musical tone apparatus or an electronic musical instrument, thereafter referred to as "said apparatus).

Each key on the keyboard 11 operates/instructs generation and attenuation of musical tones, the keyboard scan circuit 12 practices scanning; a key on/off data is detected and is written in the keyboard table in the program/data storage unit 4 by the controller (CPU) 2. Then it is compared with the data showing the on or off status of each key which has been stored in the keyboard table, and the controller 2 determines the on of off event of each key.

The keyboard 11 consists of a lower keyboard, an upper keyboard and a pedal keyboard. Each of the portions generates tones with different/same timbre, that is, tones with different/same waveform and/or envelope waveform. In some cases the keyboard 11 is replaced by an electronic stringed instrument, an electronic wind instrument, an electronic percussion instrument (pad, etc.) or a computer keyboard.

The keyboard 11 detects tempo or touch of a player's manual performance. In order to detect the touch, a speed sensor, an acceleration sensor or a pressure sensor is provided to correspond to each key of the keyboard 11.

Each switch in the panel switch group 13 is scanned by the switch scan circuit 14. This scanning detects the data showing the on or off status of each switch, and the controller 2 writes the data in the switch table in the program/data storage unit 4.

It is compared with the data showing the on or off status of each switch which has been stored in the switch table, and the controller 2 determines the on or off event of each switch. The above-mentioned panel switch group 13 includes various operation buttons and switches.

The tones are generated by manual play or automatic play replayed from the performance information of the above-mentioned keyboard 11. The performance information, the tone information, the sounding-on or off information (thereafter referred to as "tone information") is sent from the external connecting apparatus from the MIDI circuit 15. Also the tone information is sent to the external connecting apparatus through the MIDI circuit 15.

The transmitted and received information or the tone information include musical factor information and MIDI channel (s) number information regulated by MIDI standard such as timbre information (tone number data/timbre combination set), volume information (loudness data), touch information (velocity data), pitch information (key number data), range information (set-up range data) and/or envelope information.

MIDI circuit 15 is an interface to transmit and receive tone data to and from an externally connected electronic musical instrument. The tone data meets MIDI (musical instrument digital interface) standard, and sounds are generated based on the tone data. MIDI circuit 15 includes a buffer for temporarily storing tone data to be received and transmitted.

In MIDI circuit 15, switching is able to be carried out among the out-communication states (EXT) in which tone data is transmitted to an external apparatus connected to the musical tone apparatus, the in-communication states (INT) in which tone information is transmitted only within said musical tone instrument and the both-communication state (BOTH) in which the EXT and INT states are provided simultaneously corresponding to various zones/timbres/internal channel/MIDI channel(s) (thereafter referred to as "zone" or "timbre").

When the multi-timbre states is selected, the both-communication state (BOTH) is selected. When the non-multi-timbre states are selected, the out-communication states (EXT) or the in-communication states (INT) are selected. The external apparatus to be connected includes "an external sound source" or "an external sequencer" (external/out-communication).

In the multi-timbre states, tones with various timbres are outputted or inputted simultaneously. In the non-multi-timbre states while the multi-timbre states is removed, tone with a single timbre re outputted or inputted. At that time "input" means that tone data is inputted into the musical tone apparatus (the internal apparatus) from the external apparatus or via the internal apparatus such as the keyboard 11. "Output" means that tone data is outputted to the external apparatus or to the musical tone apparatus (the internal apparatus) from the internal apparatus such as the tone signal generating unit 5.

Musical tones with various timbres correspond to more than one or all of the MIDI channel(s). Tones with a single timbre correspond to one of the MIDI channel(s), i.e., the first channel.

Therefore in the multi-timber state, the above-mentioned MIDI circuit 15 is switched so that all or more than one MIDI channel(s) are received/sent. In the non-multi-timbre states the above-mentioned MIDI circuit 15 is switched so that only one of the MIDI channel(s) is received or sent.

The keyboard 11 or the MIDI circuit 15 formerly mentioned includes manually and automatically played musical instruments. The above-mentioned performance information, etc. (tone data) generated from the keyboard 11, the panel switches 13 or the MIDI circuit 15 is information to generated musical tones.

The above-mentioned tone pitch data is received as a key number data KN. The key number data KN includes octave data (tone pitch data) and tone name. The above-mentioned timbre data corresponds to the kind of the musical instruments (sounding media/sounding means) such as keyboard instruments (piano, etc.), wind instruments (flute, etc.), stringed instruments (violin, etc.), percussion instruments (drum, etc.) and are received as a tone number data TN. The above-mentioned envelope data includes the envelope speed ES, the envelope level EL, the envelope time ET and/or the envelope phase EF, etc. formerly stated.

Such musical factor data are sent to the controller (CPU) 8 where a variety of signals that will be described later, data or parameters are changed to determine the content of musical tones. The performance information, etc. is processed by the controller 8, various data are sent to the musical tone signal output unit 5, tone waveform signals are generated and the sound system 6 generates and outputs sounds. The controller 8 consists of CPU, DSP (digital signal processor) ROM and RAM.

A program/data storage unit 4 (internal storage medium/means comprises a storage unit such a ROM, a writeable RAM, a flush memory or an EEPROM. A program of a computer stored in a data storage unit 7 (external storage medium/means) such as an optical disk or a magnetic disk, is transcribed and stored (installed/transferred) into the program/data storage unit 4.

Into the program/data storage unit 4 is further stored (installed/transferred) a program transmitted from an external electronic musical instrument or a computer via the MIDI circuit 15 or the transmission/reception device. The storage medium of the program includes a communication medium.

This program complies with flowcharts that will be described later, with which the controller (CPU) 8 executes a variety of processings. The program/data storage unit 4 stores the above-mentioned musical factor data, the above-mentioned various data and other various kinds of data. These various kinds of data include data necessary for the time-division (time-sharing) processing and data to be assigned to the time-division channels.

In the tone signal generating unit 5, tone waveform signals are repeatedly generated for each tone and the sound system 6 generates and outputs sounds. In response to the above-mentioned pitch data, the speed of the repeatedly generated tone waveform signals is changed, and in response to the musical factor data such as the above-mentioned tone data, the forms of the repeatedly generated tone waveform signals are transformed. In the tone signal generating unit 5, more than one tone signals are created simultaneously and independently in parallel to generated polyphonic sounds through a time sharing process.

A timing generating unit 9 outputs timing control signals to the circuits to maintain synchronism of all circuits of the tone generating apparatus. The timing control signals include clock signals of each of the periods, signals of a logical product or a logical sum of these clock signals, channel clock signals having periods of channel-dividing time in the time-division processing, clock signals with integral multiplied or integral divided frequencies by these signals, channel number data CHNo and time count data (tone generating data). The above-mentioned scan processing is executed according to the clock signals at every particular period.

The tone signal generating unit 5 or the program/data storage unit 4 includes the assignment memory 16. The assignment memory 16 has a memory area corresponding to the number of the above-mentioned time-division channels so that the performance information tone data and musical factor data are written in to generate said tones in response to tones assigned to each channel. The tones assigned to each channel are generated or attenuated in response to the written tone data, etc.

It is hereafter referred to as "internal sound source" (interior/in-communication). Performance information, tone data and musical factor data of such an internal sound source are written and stored in the program/data storage unit 4. It is hereafter referred to as "internal sequencer" (interior/in-communication).

In the above-mentioned multi-timbre states, tone data of different tone number data (timbre) are written into each channel area of the assignment memory 16, and the tones simultaneously generated have different timbres. In the non-multi-timbre states, the same tone number data (timbre) are written into each channel area of the assignment memory 16, and the tones generated simultaneously have the same timbre (tone number data).

One channel memory area of the assignment memory 16 corresponds to one of the MIDI channel(s), and tones with respective timbre (tone number data) are written into respective MIDI channel (s). However, one channel memory area of the assignment memory 16 does not always have to correspond to one MIDI channel(s). It may correspond to the above-mentioned zone/timbre.

(2) Panel Switches 13

Figure 2:
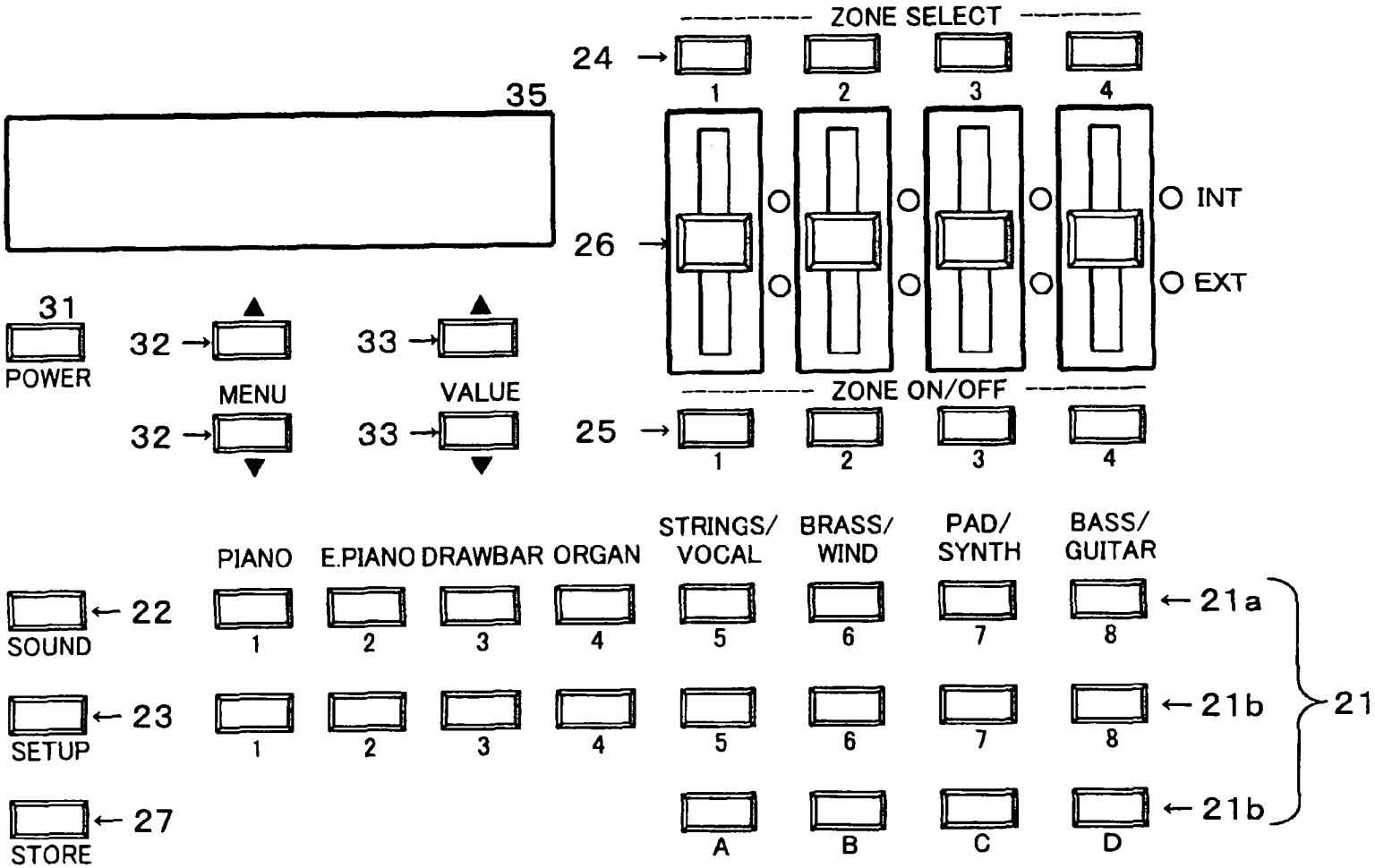
FIG. 2 illustrates a portion of the panel switches 13.

FIG. 2 shows a portion of the panel switches 13. The panel switches 13 includes timbre buttons 21, a sound button 22, a set-up button 23, zone select buttons 24, zone on/off buttons 25, zone faders 26, a power button 31, menu buttons 32, value buttons 33 and a display 35.

The timbre buttons 21 designate/select various timbre data (tone number data) to select one timbre for one tone different from one another. The sound button 22 selects a mode that the timbre buttons 21 (the timbre group buttons 21*a* and the variation buttons 21*b*) select timbre which is different from one another in a tone, as mentioned above.

The set-up button 23 selects a mode that makes a set of various timbres designated/selected by the timbre button 21 and writes in and memorizes the set, or a mode that reads out and replays the set of timbres which have been memorized.

The sets of timbres memorized in this way are classified/arranged according to the above-mentioned timbre groups and are memorized. Therefore each of the above sets of timbres is memorized corresponding to each of the above timbre buttons 21 (the timbre group button 21*a* and the variation button 21*b*), and each of the above timbre buttons 21 memorizes the corresponding timbre out of the above-mentioned various timbres.

The four "1" to "4" of the zone select buttons 24 select/designate either of the first, the second, the third or the fourth timbre of the above-mentioned set, or optional four of the MIDI channel(s). The selection and designation can be made both at writing in/memorizing time and at reading out/replaying time.

The timbre buttons 21 specifically select and decide No. N timbre that has been selected/designated among the set of timbres. In addition, the No. N timbre can be individually changed by switching the timbre buttons 21. Volume (loudness) of the tones of the No. N timbre can be individually set, selected or changed by the zone faders 26 mentioned later.

The timbre/MIDI channel(s) selected by the zone select buttons 24 is timbre selected/designated individually by the timbre buttons 21 while the sound button 22 is on, or is any of the timbre selected/designated among the timbre set by the timbre buttons 21 while the set-up button 23 is on.

When the zone select buttons 24 are pressed one after another, the transmission mode of tone data of each zone/each timbre is switched from the internal mode (in-communication states), the external mode (out-communication states) to the both mode (both-communication states) rotationally.

The data of the switched transmission mode is written and stored in the mode register 43. In the internal mode (in-communication states) the tone data is transmitted only inside the apparatus, and tones are generated/replayed only in the apparatus according to performance information from manual play/replay of the keyboard 11. In the external mode (out-communication states), tone data is transmitted to, written and stored in the external apparatus, and tones are generated in the external apparatus. Performance information from manual play/replay of the keyboard 11 is sent to the external apparatus to generate tones and the information is stored in the external apparatus. In the both mode, both the internal and external modes are selected with regard to the tone data.

By the four "1" to "4" of the zone on/off buttons 25, at every zone, generation of timbres in the above set/MIDI channel (s) can be switched rotationally in such ways that they are not generated but muted, tones in the all ranges/all keys are generated in said zone or tones in the range/key group in the set range are generated in said zone. The switched information is stored in the mode register 43 as an output state flag mentioned later.

The zone fader 26 adjusts volume/loudness of timbre of the above-mentioned set, each zone, each timbre and/or each MIDI channel(s) individually. The individual adjustment of volume of the timbre set can be made at any made such as a writing-in/storage or a reading-out/replay mode. The zone fader 26 changes/adjusts a relative balance of volume of timbre/zone in the internal mode (INT) and the external mode (EXT).

Timbers of the above-mentioned set/MIDI channel(s) are selected by the zone select buttons 24 when timbers are written in/stored and by the zone on/off buttons 25 when it is read out/replayed. Therefore the selection of the timbre is made by an operator.

The menu buttons 32 switch and select menus shown on the display 35. The menus include various musical factors mentioned before. The value buttons 33 increase/decrease and switch content/value/volume of the musical factors of the selected menus.

The buttons 32 and 33 switch the on (the multi-timbre states)/off (the non-multi-timbre states) of the multi-timbre.

By pressing the menu buttons 32, the display 35 shows "multi-timbre on" or "multi-timbre off". The on/off is switched by the value buttons 33. The power button 31 turns on and off the whole apparatus. When it is turned on, the initializing process is executed.

(3) Mode Register 43

FIG. 3 shows the mode register 43. The mode register 43 memorizes the modes of the multi-timbre ("1") or the non-multi-timbre ("0"). In the multi-timbre mode, tones with various timbres are generated simultaneously, and in the non-multi-timbre mode while the multi-timbre mode is removed, tones with a single timbre are generated.

The multi-timber mode data is not volatile and is not erased when the power is off. Or the on/off of the mode switch (not illustrated) for the multi-timbre may be recognized when the power is turned on and may be written in the mode register 43.

The mode register 43 memorizes the three modes of the internal (INT), the external (EXT) and the both (BOTH) modes per each of the four zones (channel/timbre). At the internal (INT) mode (in-communication states), tone data is transmitted only within the main apparatus (internal sound source/internal sequencer). At the external (EXT) mode (out-communication states), tone data is transmitted out to the external apparatus (external sound source/external sequencer). At the both (BOTH) mode (both-communication states) the in and out-communication states are provided at the same time.

An output state flag is memorized per each of the four zones (channel/timber). The output state flag shows generation/output or non-generation/non-output of timbre of the timbre set/MIDI channel (s) in response to pressing the zone on/off buttons 25.

For all the four zones (channel/timbre), at the output state flag "0" only the tones with the timbre included in said zone in the timbre set/MIDI channel(s) are muted and not generated. At the output state flag "1", tones in all the ranges/all the keys or a specific range of the keyboard 11 are generated in the timbres in said zone.

(4) Overall Processing

Figure 4:
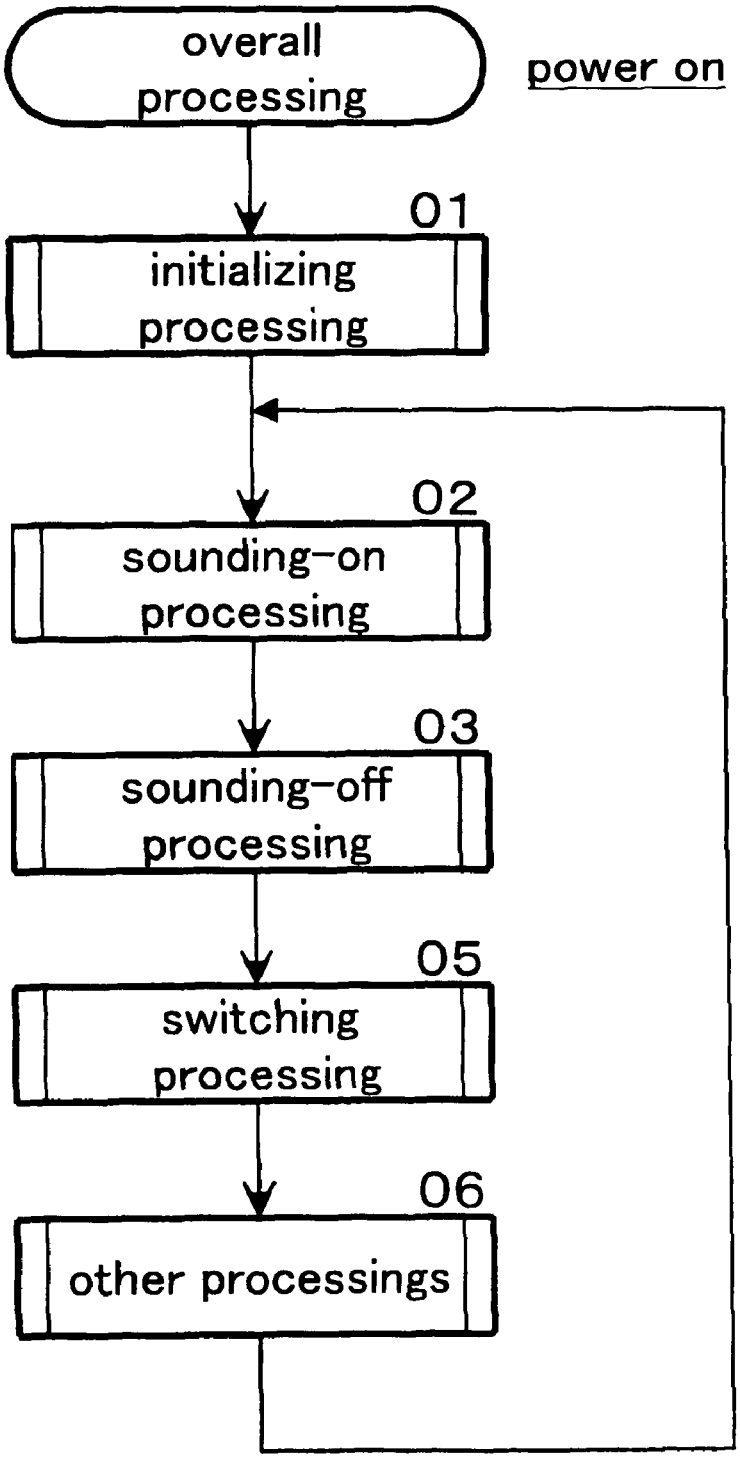
FIG. 4 is a diagram of a flowchart of the overall processing executed by the controller (CPU) 8.

FIG. 4 shows a flowchart of the overall processing executed by the controller (CPU) 8. The overall processing starts as the power source of the tone generating apparatus is turned on, and is repetitively executed until the power source is turned off. First a variety of initialize processing such as initializing the program/data storage unit 4, etc. are executed (step 01), and the sounding-on processing is executed based on the key-on operation of the manually play of the keyboard 11 (step 02).

The sounding-on processing is executed also when the key-on data of the automatic play is read out from the program/data storage unit 4 while reading out and replaying the above-mentioned performance information. The step 02 sounding-on processing is executed also when the key-on data of the automatic play is written into the program/data storage unit 4 while writing in and recording the performance information.

In the sounding-on processing, vacant channels are searched, and musical tones related to the on-event are assigned to the vacant channels that have been searched. Contents of the musical tones are determined by musical factor data of performance information (tone data) and tone generating data from the keyboard 11 and the panel switches 13.

In this case, the on/off data of "1", the key number data (frequency number data) KN, envelope data, tone number data TN and touch data TC are written into the areas of the assignment memory of vacant channels that have been searched. The data written into the assignment memory is transmitted to the tone generating unit 5 to get the corresponding tone waveform data read out and the corresponding envelope waveform data outputted so that sounds are generated by the sound system 6.

Then the sounding-off (attenuation) processing if effected based on the key-off operation of the manual play with the keyboard 11/panel switches 13 (step 03). In the sounding-off (attenuation) processing, channels to which assigned are the tones related to the off event (key-off event, sounding-off event) are searched, and the on/off data in the assignment memory (not illustrated) is made "0" to attenuate and sound of the tones. In this case, the on/off data "0" in the assignment memory is transmitted to the tone signal generating unit 5 to release the envelope phases of the tones related to the key-off event, and the envelope levels gradually approach to "0".

The sounding-off processing in the step 03 is executed when the key-off data of automatic play is read out from the program/data storage unit 4 while reading out and replaying performance information. The sounding-off processing in the step 03 is also executed when the key-off data of automatic play is written into the data storage unit 4 while writing in and recording performance information.

By operating with the panel switches 13, the corresponding musical factor data are taken in and are stored in the program/data storage unit 4 to change the musical factor data (step 05). This switching operation practices selection of timbres and writing in reading out of the timbre set, followed by other processing (step 06). The processing is repeated from the step 02 through up to the step 06.

(5) Initializing Processing (Step 01)

Figure 5:
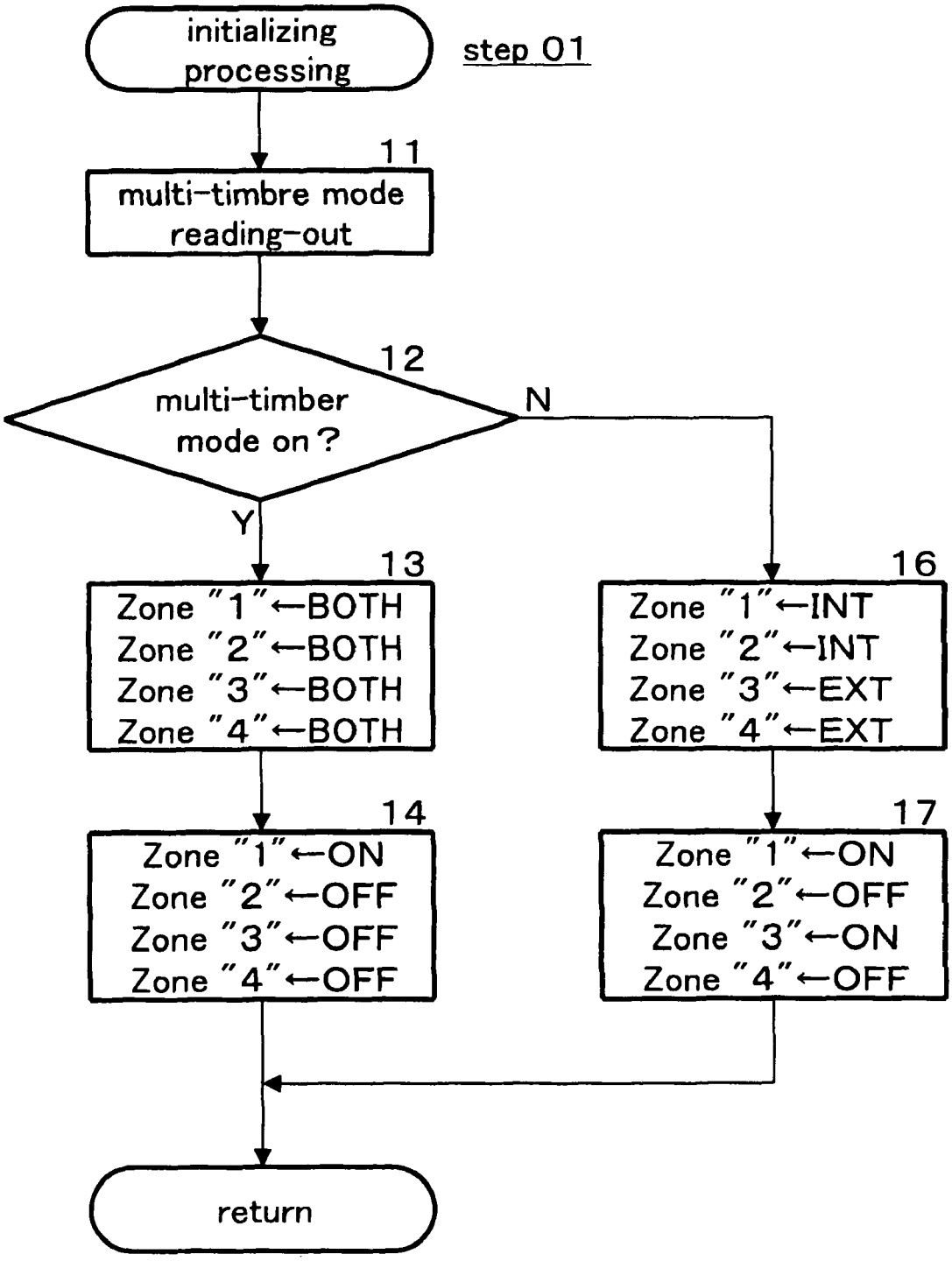
FIG. 5 is a diagram of a flowchart of the initialize processing (step 01).

FIG. 5 shows a flowchart of the initializing processing. First the mode data of the multi-timbre are read out in the mode register 43 (step 11). If the mode data read out shows the multi-timbre states ("1") (step 12), the both mode (BOTH) data is written into the zones (timbre/MIDI channel (s)) "1" to "4" in the mode register 43.

Through this process, the both in and out-communication states are selected for the all zones/timbres while transmitting the tone data to make it convenient to write-in/record and read-out/replay with the external apparatus and make unnecessary a complicated setting/switching of the modes. In addition some or all of the MIDI channel (s) are able to be received/sent, which is a suitable condition for the multi-timbre function as various settings are made unnecessary.

When writing-in/recording or reading-out/replaying are carried out in the external apparatus (the external sequencer) and performance/sounding generation are carried out in the internal sound source and if musical factors such as timbre are changed, the changed information (program change) has to be transmitted to both the external sequencer and the internal sound source. That is because the musical factors (timbres) become different in the external sequencer and in the internal sound source. This is very suitable for the multi-timber which generates tones with various timbres simultaneously. And if each of the various timbres is not unified internally and externally/in-communication and out-communication, the timbres become confused and not to get the multi-timbre function unified in the connected apparatuses.

In the both (BOTH) mode the same information is transmitted externally and internally, so that the changed information is commonly provided and musical factors are unified both externally and internally and/or in-communication and out-communication.

If the zone select buttons 24 are pressed, the both mode is switched to the external or internal mode for each zone/timbre. All of the four zones/timbres are not in the both mode, but one or some of them may be. The rest of the zones are in the internal or external mode. It is the same for the external sound source and the internal sound source and is suitable for unifying externally/out-communication and internally/in-communication.

The output state flag of the zone "1" is turned on into the "1" state, the output state flag of the zone "2" is turned on into the "0" state, the output state flat of the zone "3" is turned on into the "0" state, and the output state flat of the zone "4" is turned on into the "0" state (step 14).

Accordingly since only the zone "1" is turned to generate sounds/output power, at least in the zone "1", internally and externally and/or the in and out-communication states are unified to generate sounds/output power. At the step 14 the zone on/off buttons 25 are turned on in the other zones, and some or all of the other zones generate sounds/output power.

At the step 12 if the read-out mode data shows the non-multi-timbre states ("0")(step 12), the internal (INT) mode data is written into the zone (timbre/MIDI channel(s)) "1" and "2", and the external (EXT) mode data is written into the zone "(timbre/MIDI channel(s)) "3" and "4" of the mode register 43 (step 16).

As a result, while transmitting tone data, either out or in-communication states is selected for each zone/timbre, which is convenient when the external apparatus is used only as a sound source from outside or inside, and complicated mode setting/changing becomes unnecessary. Also only one of MIDI channel(s) is sent or received, which is suitable for the non-multi-timbre function and various setting becomes unnecessary.

Moreover musical factors such as timbres of only the external apparatus are changed, musical factors such as timbres of only the internal apparatus are changed, and the external and internal changes take place separately. In this way when musical control is carried out in the external apparatus and the internal apparatus individually and separately, the non-multi-timbre is selected and either the external mode in the out-communication states only or the internal mode in the in-communication states only is selected. As a result different and individual control is provided easily externally and internally.

If the zone select button 24 is pressed, the external mode or the internal mode can be changed to the both mode, the internal mode or the external mode for each zone/timbre. The zone/timbre that can be changed to the internal mode are not only the zones "1" "2", but may be one of the zones "1" "2", some or all of the zones.

The rest of the zones become the external or the both mode. The zone/timbre that can be changed to the external mode are not only the zones "3 "4", but may be one of the zones "3" "4", some or all of the zones. The rest of the zones become the internal mode or the both mode.

And the output state flag of the "1" is turned on into the "1" state, the output state flag of the zone "2" is turned on into the "0" state, the output state flag of the zone "3" is turned on into the "1" state, and the output state flag of the zone "4" is turned on into the "0" state (step 17).

Accordingly only the zones "1" and "3" generate sounds/output power. Therefore at least in the zone "1" or "3", the interior and the exterior and/or the in-communication and out-communication states are separately controlled, and sounding on/output are carried out. At the step 17 the zone on/off buttons 25 are turned on in the other zones and some or all of the other zones generate sounds/output power.

In the above-mentioned both (BOTH) and external (EXT) modes, the real-time transmission of tone data is carried out between the main apparatus and the external apparatus, and the real-time wringing-in and storage/reading-out and replay are carried out between the main and external apparatuses. In the both (BOTH) mode and the external (EXT) mode, after tone data are transmitted collectively between the main and external apparatuses, collectively sent to the external apparatus and written in and stored, the tone data may be read out and replayed and then received collectively at the main apparatus.

(6) Sounding On/Off Processing (Step 02/Step 03)

Figure 6:
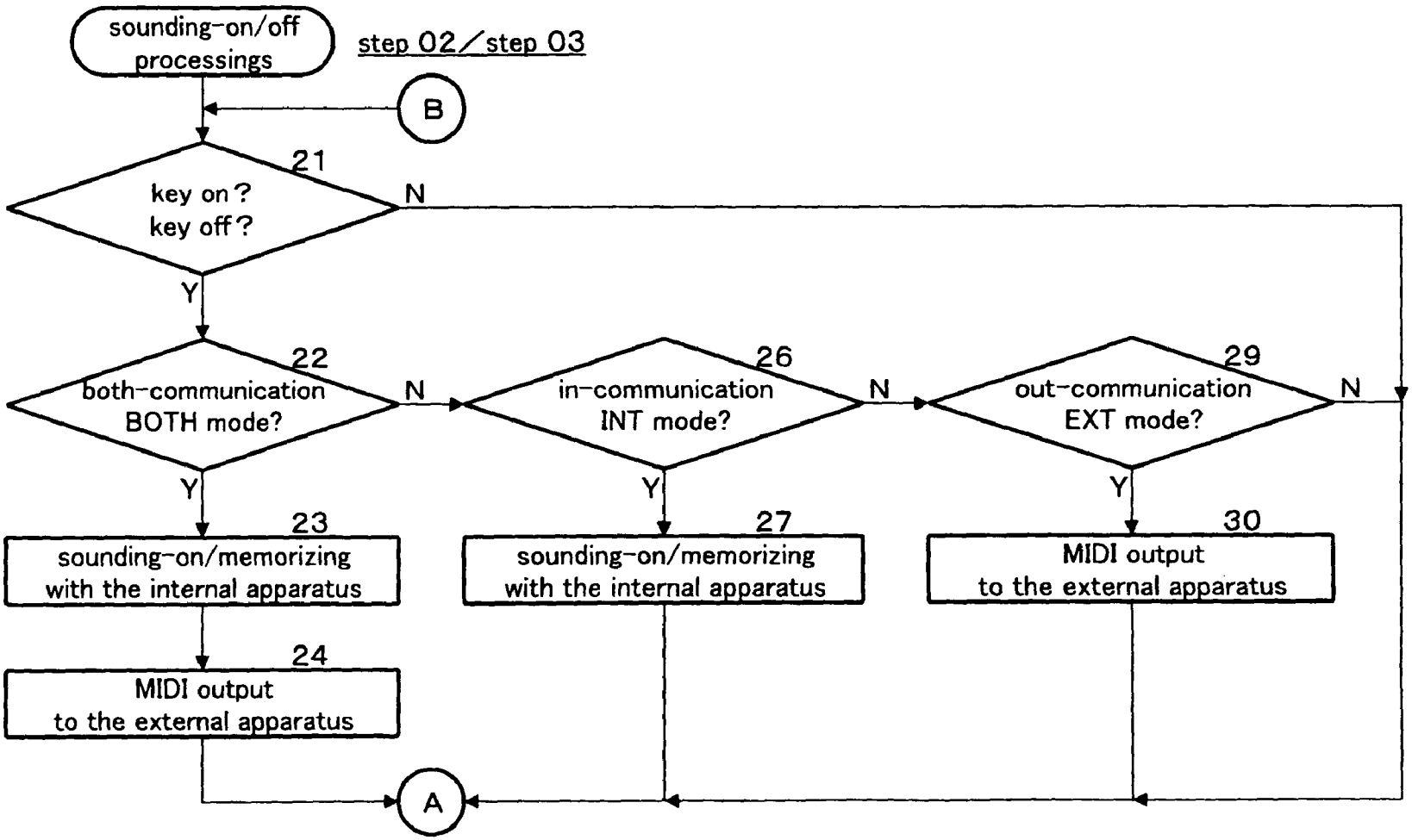
FIG. 6 is a diagram of a flowchart of the sounding-on or off processing (step 02 or step 03).
Figure 7:
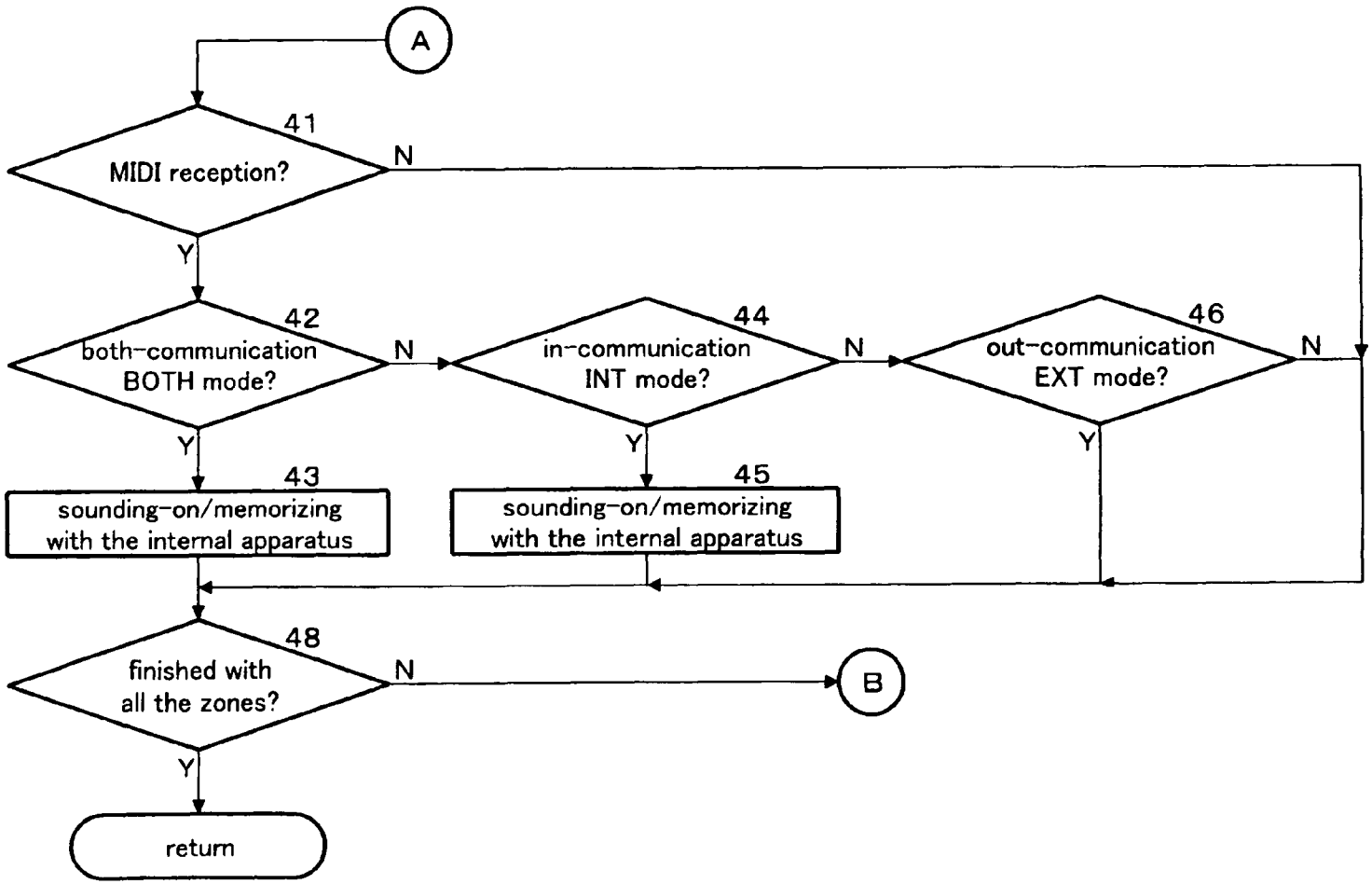
FIG. 7 is a diagram of a flowchart of the sounding-on or off processing (step 02 or step 03).

FIGS. 6 and 7 show flowcharts of the above-mentioned sounding-on or off processing (step 02 or 03). When the key-on or the key-off takes place (step 32), tone data are written into the assignment memory 16, the tone signal generating unit 5 practices sounding-on/output or sounding-off/output, the internal sound source is driven, and tone data are written into the program/data storage unit 4 and stored in the internal sequencer (step 23). And the tone data are sent to the MIDI circuit 15 and transmitted to the external apparatus and the external sound source is driven and the data are stored in the external sequencer (step 24).

If each zone is selected/set as an internal mode according to the stored data of the mode register 43 (step 26), tone data are written into the assignment memory 16, the tone signal generating unit 5 practices sounding-on/output or sounding-off/output, the internal sound source is driven, and tone data are written into the program/data storage unit 4 and stored in the internal sequencer (step 27).

If each zone is selected/set as an external mode (step 29), tone data are sent to MIDI circuit 15 and transmitted to the external apparatus, the external sound source is driven and the data are stored in the external sequencer (step 30)

Then if tone data are sent to MIDI circuit 15 from the external apparatus (step 41), the tone data are written into the above-mentioned assignment memory, the tone signal generating unit 5 practices sounding-on/output or sounding-off/output, the internal sound source is driven, and the tone data are written into the program/data storage unit 4 and stored in the internal sequencer according to the stored data of the mode register 43 if each of the zones is selected/set as the both mode (step 43).

According to the stored data of the mode register 43, if each of the zones is selected/set as the internal mode (step 44), tone data are written into the assignment memory 16, the tone signal generating unit 5 practices sounding-on/output, the internal sound source is driven, and the tone data are written into the program/data storage unit 4 and stored in the internal sequencer (step 45).

According to the stored data of the mode register 43, if each of the zones is selected/set as the external mode (step 46), no operations are performed. The steps 21 to 46 mentioned above are processed respectively for each of the zones "1" to "4" (step 48).

The step 45 is eliminated. In the internal mode if MIDI receiving takes place (step 41), the internal sound source does not necessarily perform sounding on/off. In the external mode (step 46) when MIDI receiving takes place (step 41), the internal sound source may perform sounding on/off as in the step 45. The step 43 is eliminated. In the both mode if MIDI receiving takes place (step 41), the internal sound source may not perform sounding on/off.

Thus in the internal mode (the in-communication states), tone data are transmitted only inside the main apparatus. Sounds are generated and replayed by the main apparatus based on the performance information derived from manual operation/replay of the keyboard 11.

In the external mode (the out-communication states), tone data are transmitted to, written and stored in the external apparatus, and then it performs sounding on. And the performance information operated manually/replayed with the keyboard 11 is generated by/stored in the external apparatus.

In the both mode, both the in and out-communication states of the above tone data are selected. The performance information operated manually/replayed with the keyboard 11 is generated/replayed in the main apparatus, while the tone data are received from the external apparatus read out and replayed and the sounds are generated from the main apparatus. Then the tone data are transmitted to, written and stored in the external apparatus, the tones are generated from the external apparatus and the performance information operated manually/replayed with the keyboard 11 is generated by/stored in the external apparatus.

(7) Switch Processing (Step 05)

Figure 8:
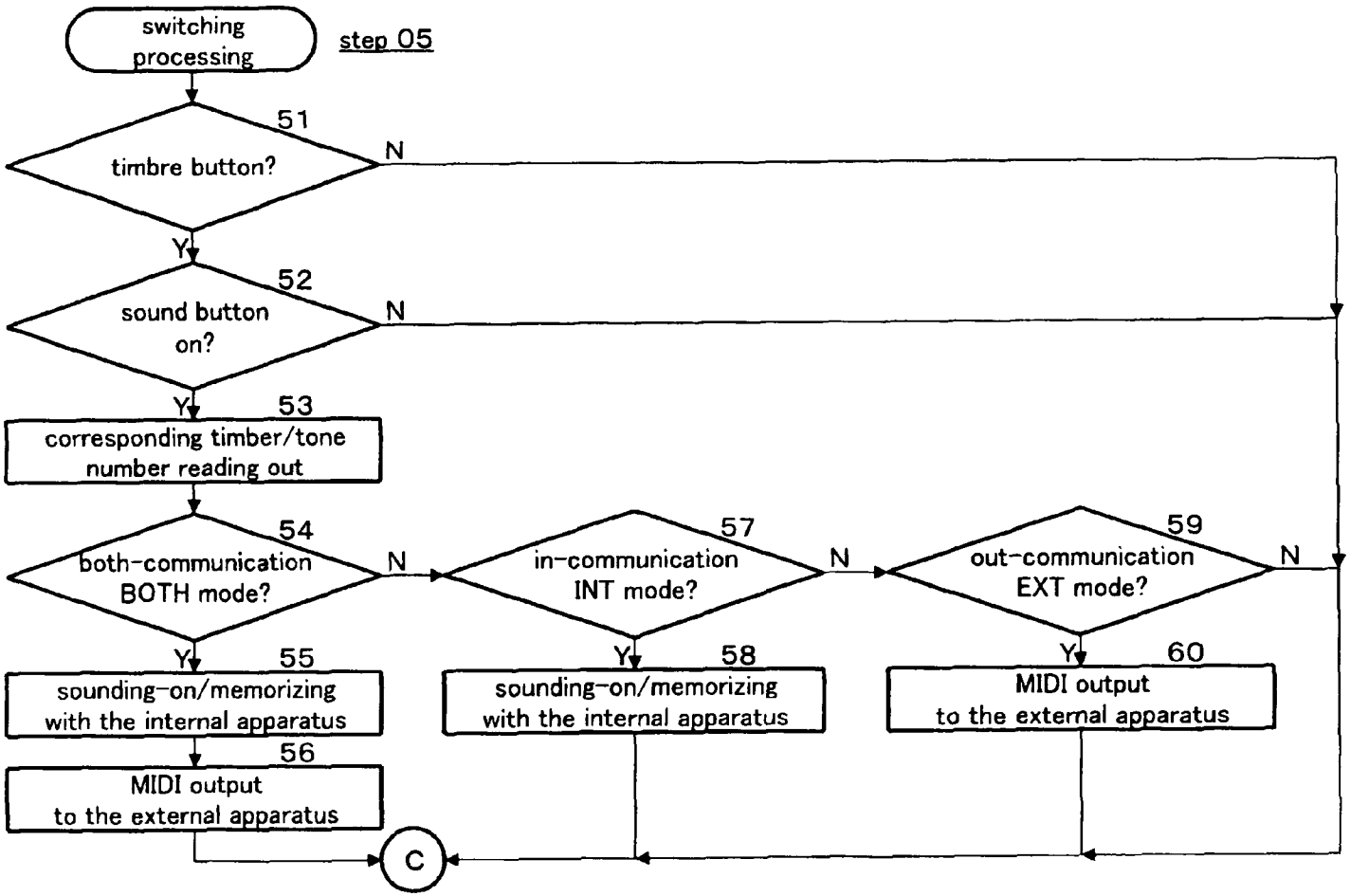
FIG. 8 is a diagram of a flowchart of the functioning processing of the timbre button 21 in the switching processing (step 05).
Figure 9:
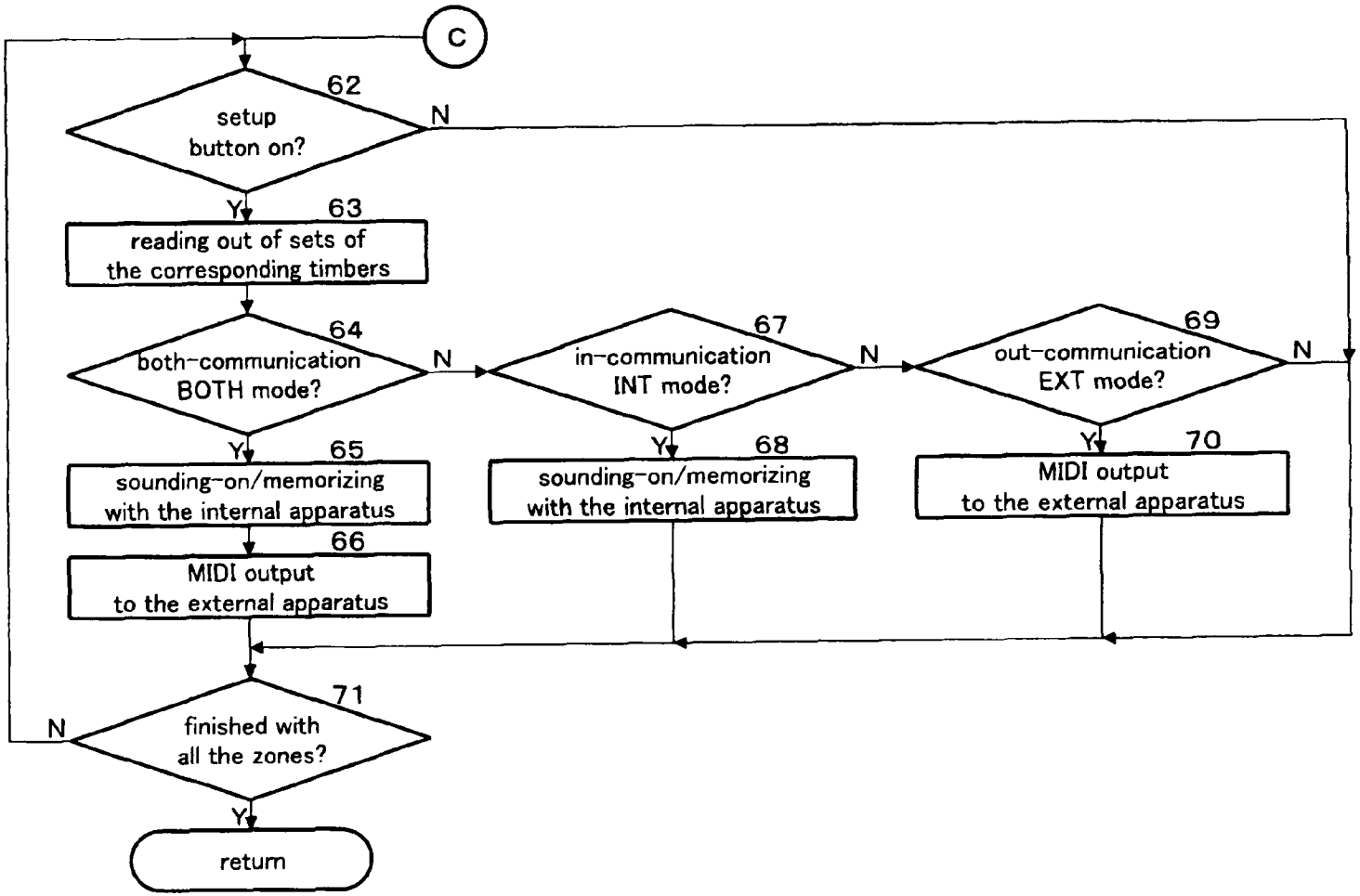
FIG. 9 is a diagram of a flowchart of the functioning processing of the timbre button 21 in the switching processing (step 05).

FIG. 8 and FIG. 9 show flowcharts of processing operated with timbre buttons 21 in the switch processing (step 05). First, when the timbre buttons 21 are pressed (step 51) and if the sound button 22 is also pressed (step 52), the tone number data (timbre data/timbre code) corresponding to the pressed timbre button 21 is read out from the program/data storage unit 4 (step 53).

Then to the mode register 43, the zone select buttons 24 are turned on and the transmission mode of the tone data of the timbre is recognized for the zone in which the output state flag is on (steps 54, 57 and 59).

If the mode is selected and set as the both mode (step 54), the tone number data written into the assignment memory 16 are switched, timbres of tones generated/outputted from the tone signal generating unit 5 are changed, timbres of tone data written into the program/data storage unit 4 are changed and timbres of the tone data transmitted inward are changed (step 55). And the timbres of the tone data sent to MIDI circuit 15 and to the external apparatus are changed as well (step 56).

If the mode is selected and set as the internal mode (step 57), the tone number data written into the assignment memory 16 are switched, timbres of tones generated/outputted from the tone signal generating unit 5 are changed and timbres of tone data written into the program/data storage unit 4 are changed and timbres of the tone data sent inward are changed (step 58).

If the mode is selected/set as the external mode (step 59), timbres of the tone data sent to MIDI circuit 15 are changed and timbres of the tone data sent to the external apparatus are changed as well (step 60).

When the timbre buttons 21 are pressed in the step 11 and if the setup button 23 is also pressed (step 62), some tone number data (a combination set of timbres/timber data) corresponding to the pressed timber button 21 are read out from the program/data storage unit 4 (step 63). And the transmission mode of tone data of the timbres in each zone memorized in the mode register 43 is recognized (step 64, 67 and 69).

If the mode is selected/set as the both mode (step 64), the none number data written into the assignment memory 16 are switched, tone generated/outputted from the tone signal generating unit 5 are changed, timbres of tone data written into the program/data storage unit 4 are changed and timbres of the tone data sent inward are changed as well (step 65). And timbres of the tone data sent to MIDI circuit 15 and to the external apparatus are also changed (step 66).

If the mode is selected/set as the internal mode (step 67), the tone number data written into the assignment memory 16 are switched, tones generated/outputted from the tone signal generating unit 5 are changed, timbres of tone data written into the program/data storage unit 4 are changed, and timbres of tone data sent inward are also changed (step 68).

If the mode is selected/set as the external mode (step 69), timbres of the tone data transmitted to MIDI circuit 15 are changed and timbres of the tone data transmitted to the external apparatus are changed (step 70). The processes of the steps 61 to 70 are practiced for each of the four zones "1" to "4" (step 71).

Thus when timbres are changed by the timbre buttons 21, timbres sent to the internal and external apparatuses are changed in the both mode. In the internal mode changed are timbres only transmitted to the internal apparatus, and in the external mode changed are timbres only transmitted to the external apparatus.

Such changes are able to be made for other musical factors than timbres. In such cases the tone number data in the steps 51 to 71 the processes are entirely replaced by velocity data, loudness data, pitch and range data (octave data) and/or envelope data.

(8) Description of the Other Embodiments

The present invention is not limited to the embodiment mentioned above but some modification is allowed as far as it does not be deviated from the purpose of the invention. For example, selection of the in or out-communication states is referred to about the sending mode of the tone data in each of the zones. However such selection is possible for the receiving mode of tone data in each of the zones. The steps 41 to 48 in the FIG. 7 show the example.

To be more specific, in the multi-timbre states, tone data received through MIDI circuit 15 are outputted, written and stored in the internal apparatus to generate sounds (step 43).

In the non-multi-timbre states, nothing takes place or the tone data received through MIDI circuit 15 is outputted to, written and stored in the internal apparatus to generate sounds (step 45).

The initializing processing in the step 01 may be carried out when the power is turned on and off, or when two of the buttons, for example, the left two of the timbre buttons 21 are pressed at the same time, or when the reset button (not illustrated) is operated. Or such initializing processing may be performed when some processes are carried out.

In the above mentioned in, out or both states, tone data transmitted to and from the external apparatus through MIDI circuit 15 are or may include timbre data (tone number data/a combination set of timbres) and musical factor data such as volume data (loudness data), touch data (velocity data), pitch data (key number data), range data (setup range data) or envelope data.

The number of timbres of the above mentioned combination set, that is, the number of zones is not necessarily four and may be two, three, five or more. Corresponding to the number, the number of the zone select buttons 24, the zone on/off buttons 25 and the zone faders 26 is two, three, five or more.

In the steps 16 and 17 shown in FIG. 5, different timbres/MIDI channel (s) are assigned to the zone "1" set for the internal mode (INT) and to the zone "3" set for the external mode (EXT), but the same timbres/MIDI channel (s) may be assigned.

(9) The Other Effects of the Present Invention

[1] A musical tone output switching method wherein: the multi-timbre states in which tones with various timbres are outputted or inputted simultaneously and the non-multi-timbre states in which tones with a single timbre are outputted or inputted with the multi-timbre states removed are switched; the out-communication states in which tone data are transmitted to the external apparatus connected to the tone apparatus, the in-communication states in which tone data are transmitted only inside said tone apparatus, and the both-communication states in which the out and in-communication states are provided simultaneously are switched; said both-communication states is selected to send and receive tone data when said multi-timbre states is selected, and either of said out or in-communication states is selected when said non-multi-timbre states is selected.

Therefore timbres are changed uniformly in the external apparatus and the internal apparatus (the tone apparatus) in the multi-timbre states, while in the non-multi-timbre states timbres of the external apparatus and the internal apparatus (the tone apparatus) are able to be changed separately.

[2] A computer program for switching musical tone output to make a computer perform processing wherein: processing for switching the multi-timbre states in which tones with various timbres are outputted or inputted simultaneously and the non-multi-timbre states in which tones with a single timbre are outputted or inputted with the multi-timbre states removed; processing for switching the out-communication states in which tone data are transmitted to the external apparatus connected to the tone apparatus, the in-communication states in which tone data are transmitted only inside said tone apparatus, and the both-communication states in which the out and in-communication states are provided simultaneously; processing for selecting said both-communication states to send and receive tone data when said multi-timbre states, and selecting either of said out or in-communication states when said non-multi-timbre states is selected.

Therefore timbres are changed uniformly in the external apparatus and the internal apparatus (the tone apparatus) in the multi-timbre states, while in the non-multi-timbre states timbres of the external apparatus and the internal apparatus (the tone apparatus) are able to be changed separately.

[3] A musical tone output switching apparatus comprising wherein: the first switch means for switching the multi-timbre states in which tones with various timbres are outputted or inputted simultaneously and the non-multi-timbre states in which tones with a single timbre are outputted or inputted with the multi-timbre states removed; the second switch means for switching the out-communication states in which tone data are transmitted to the external apparatus connected to the tone apparatus, the in-communication states in which tone data are transmitted only inside said tone apparatus, and the both-communication states in which the out and in-communication states are provided simultaneously; selection means for selecting said both-communication states to send and receive tone data when said multi-timbre states is selected, and selecting either of said out or in-communication states when said non-multi-timbre states is selected.

Therefore timbres are changed uniformly in the external apparatus and the internal apparatus (the tone apparatus) in the multi-timbre states, while in the non-multi-timbre states timbres of the external apparatus and the internal apparatus (the tone apparatus) are able to be changed separately.

[4] The musical tone output switching apparatus according to claim 3, wherein: the out/in/both-communication states of said tone data are switched when the musical tone output switching apparatus is turned on, the musical tone output switching apparatus is initialized, and the processing to initialize the musical tone output switching apparatus are carried out.

Therefore the most suitable transmission mode is set initially for the multi-timbre/non-multi-timbre states and makes it unnecessary to switch the modes.

[5] The musical tone output switching apparatus according to claim 3, wherein: said tone data sent and received are timbre data or musical factor data, the timbre data or the musical factor data of the external apparatus only are changed in said out-communication states, the timbre data or the musical factor data of the musical tone apparatus only are changed in said in-communication sates, and the timbre data or the musical factor data of both the external apparatus and tone apparatus are changed in the both-communication states.

Therefore timbres of only the external apparatus are changed in the out-communication states, timbres of the internal apparatus (the tone apparatus) are changed in the in-communication states and timbres of both the external and internal (tone) apparatuses are changed in the both-communication states.

[6] The musical tone output switching apparatus according to claim 3 wherein: the out-communication states is selected for at least one musical tone, and the in-communication states is selected for at least another musical tone when said non-multi-timber states is selected.

Therefore timbres for the out-communication and for the in-communication are able to be separated, and timbres of only the out-communication or timbres of only the in-communication are able to be changed exclusively and separately.

[7] The musical tone output switching apparatus according to claim 3 wherein: the both-communication states are selected for at least one, some or all of said various musical tones when said multi-timbre states are selected.

Therefore at least one timbre is able to be secured to send tone data both inward and outward.

The invention claimed is:

1. A musical tone output switching method wherein:

switching between a multi-timbre state in which tones with various timbres are outputted or inputted simultaneously and a non-multi-timbre state in which tones with a single timbre are outputted or inputted with the multi-timbre state removed;

switching between an out-communication state in which tone data is transmitted to the external apparatus connected to a tone apparatus, an in-communication state in which said tone data is transmitted only inside said tone apparatus, and a both-communication state in which the out and in-communication states are provided simultaneously, selecting said both-communication state for different sets of timbre each representing at least one timbre to send and receive said tone data when said multi-timbre state is selected;

selecting at least one of the out, in, or both-communication states of said tone data when the musical tone output switching apparatus is turned on, the musical tone output switching apparatus is initialized, or processing to initialize the musical tone output switching apparatus is carried out;

selecting the out-communication state for a first musical tone, selecting the in-communication state for a second musical tone, and transmitting separately the first musical tone corresponding to the out-communication state and the second musical tone corresponding to the in-communication state, all when said non-multi-timbre state is selected, wherein said tone data sent and received is timbre data or musical factor data the timbre data or the musical factor data of only the external apparatus is changed in said out-communication state, the timbre data or the musical factor data of only the musical tone output switching apparatus is changed in said in-communication state, and the timbre data or the musical factor data of both the external apparatus and tone output switching apparatus are changed in the both-communication state.

2. A non-transitory computer-readable medium storing a computer program for switching musical tone output, which when executed causes processing by a processor, the processing comprising:

processing for switching between a multi-timbre state in which tones with various timbres are outputted or inputted simultaneously and a non-multi-timbre state in which tones with a single timbre are outputted or inputted with the multi-timbre state removed;

processing for switching between an out-communication state in which tone data is transmitted to an external apparatus connected to a tone apparatus, an in-communication state in which said tone data is transmitted only inside said tone apparatus, and a both-communication state in which the out and in-communication states are provided simultaneously;

processing for selecting said both-communication state for different sets of timbre each representing at least one timbre to send and receive said tone data when said multi-timbre state is selected;

processing for selecting at least one of the out, in, or both-communication states of said tone data when the musical tone output switching apparatus is turned on, the musical tone output switching apparatus is initialized, or processing to initialize the musical tone output switching apparatus is carried out; and selecting the out-communication state for a first musical tone, selecting the in-communication state for a second musical tone, and transmitting separately the first musical tone corresponding to the out-communication state and the second musical tone corresponding to the in-communication state, all when said non-multi-timbre state is selected, wherein said tone data sent and received is timbre data or musical factor data, the timbre data or the musical factor data of only the external apparatus is changed in said out-communication state, the timbre data or the musical factor data of only the musical tone output switching apparatus is changed in said in-communication state, and the timbre data or the musical factor data of both the external apparatus and tone output switching apparatus are changed in the both-communication state.

3. A musical tone output switching apparatus comprising:

a first switch means for switching between a multi-timbre state in which tones with various timbres are outputted or inputted simultaneously and a non-multi-timbre state in which tones with a single timbre are outputted or inputted with the multi-timbre state removed;

a second switch means for switching between an out-communication state in which tone data is transmitted to an external apparatus connected to the tone output switching apparatus, an in-communication state in which said tone data is transmitted only inside said tone output switching apparatus, and a both-communication state in which the out and in-communication states are provided simultaneously; and selection means for selecting said both-communication state for different sets of timbre each representing at least one timbre to send and receive said tone data when said multi-timbre state is selected, selecting the out-communication state for a first musical tone, selecting the in-communication state for a second musical tone, and transmitting separately the first musical tone corresponding to the out-communication state and the second musical tone corresponding to the in-communication state, all when said non-multi-timbre state is selected, and selecting at least one of the out, in, or both-communication states of said tone data when the musical tone output switching apparatus is turned on, the musical tone output switching apparatus is initialized, or processing to initialize the musical tone output switching apparatus is carried out, wherein said tone data sent and received is timbre data or musical factor data, the timbre data or the musical factor data of only the external apparatus is changed in said out-communication state, the timbre data or the musical factor data of only the musical tone output switching apparatus is changed in said in-communication state, and the timbre data or the musical factor data of both the external apparatus and tone output switching apparatus are changed in the both-communication state.

4. The musical tone output switching apparatus according to claim 3, wherein:

said out-communication state allows said tone data to only be transmitted to the external apparatus connected to the tone output switching apparatus.

5. The musical tone output switching apparatus according to claim 3, wherein:

the both-communication state is selected for at least one musical tone when said multi-timbre state is selected.

6. The musical tone output switching apparatus according to claim 3, wherein:

a first musical factor of the first musical tone corresponding to the out-communication state is different from a second musical factor of the second musical tone corresponding to the in-communication state.

7. The musical tone output switching apparatus according to claim 6, wherein:

a first timbre of the first musical tone corresponding to the out-communication state is different from a second timbre of the second musical tone corresponding to the in-communication state.

8. The musical tone output switching apparatus according to claim 3, wherein:

the out-communication state is selected for a first musical tone, the in-communication state is selected for a second musical tone, and the first musical tone corresponding to the out-communication state is transmitted separately from the second musical tone corresponding to the in-communication state, all when said multi-timbre state is selected.

9. The musical tone output switching apparatus according to claim 8, wherein:

the both-communication state is selected for at least one musical tone when said multi-timbre state is selected.

10. The musical tone output switching apparatus according to claim 8, wherein:

a first musical factor of the first musical tone corresponding to the out-communication state is different from a second musical factor of the second musical tone corresponding to the in-communication state.

11. The musical tone output switching apparatus according to claim 10, wherein:

a first timbre of the first musical tone corresponding to the out-communication state is different from a second timbre of the second musical tone corresponding to the in-communication state.

* * * * *